US008500360B1

(12) United States Patent
Jones

(10) Patent No.: US 8,500,360 B1
(45) Date of Patent: Aug. 6, 2013

(54) TRAFFIC BARRIER DEPLOYMENT SYSTEM

(76) Inventor: Fred A. Jones, Olathe, KS (US)

( * ) Notice: Subject to any disclaimer, the term of this patent is extended or adjusted under 35 U.S.C. 154(b) by 0 days.

(21) Appl. No.: 13/547,465

(22) Filed: Jul. 12, 2012

(51) Int. Cl.
*E01F 9/013* (2006.01)
*E01F 9/093* (2006.01)

(52) U.S. Cl.
USPC ..... 404/9; 256/13.1

(58) Field of Classification Search
CPC ..... E01F 9/093
USPC ..... 404/9
See application file for complete search history.

(56) References Cited

U.S. PATENT DOCUMENTS 4,119,301 A * 10/1978 Payne ..... 256/41
4,936,485 A 6/1990 Downing
5,029,819 A * 7/1991 Kane ..... 256/24
5,054,648 A 10/1991 Luoma
5,213,464 A 5/1993 Nicholson et al.
5,244,334 A 9/1993 Akita et al.
5,269,623 A * 12/1993 Hanson ..... 404/6
5,525,021 A 6/1996 Larguier
6,142,701 A * 11/2000 Falcon ..... 404/6
6,435,369 B1 8/2002 Poursayadi
6,726,434 B2 4/2004 Orthaus et al.
6,733,204 B1 * 5/2004 Paniccia ..... 404/6
6,752,582 B2 6/2004 Garcia
6,782,653 B1 * 8/2004 Thomas ..... 43/3
6,807,999 B1 * 10/2004 Bowen et al. ..... 160/24
6,969,185 B1 * 11/2005 Adair ..... 362/542
7,217,061 B2 * 5/2007 Stratton ..... 404/6
7,300,096 B2 * 11/2007 Maguire ..... 296/136.12
7,337,822 B2 * 3/2008 Snyder et al. ..... 160/23.1
7,600,554 B1 * 10/2009 Wright et al. ..... 160/327
8,087,443 B2 * 1/2012 Snyder et al. ..... 160/29
2006/0054461 A1 3/2006 Jordan

* cited by examiner

*Primary Examiner* — Raymond W Addie

(57) ABSTRACT

A traffic cone system for deploying a banner of flat traffic cones featuring a base spool pivotally anchored in the inner cavity of a utility vehicle and a deployment spool. A banner of flat traffic cones is wound around the base spool and is connected to the deployment spool. The deployment spool is mounted above an extension shaft and a ground base. The ground base can be anchored to the ground surface. The extension shaft can position the deployment spool at an appropriate height. The banner can be unwound from the base spool to display a plurality of flat triangle cones resembling traffic cones.

8 Claims, 7 Drawing Sheets

(Side View)

(Top View)

(Top View)

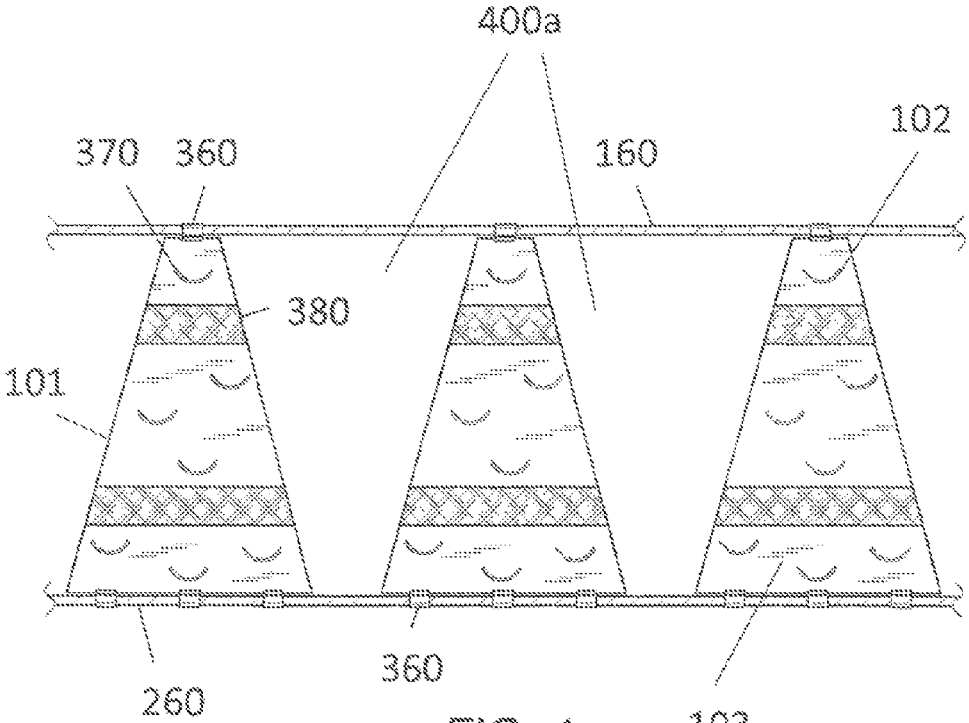
FIG. 4
(Detail View)
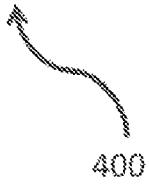

(Top View)

(Bottom View)

TRAFFIC BARRIER DEPLOYMENT SYSTEM

BACKGROUND OF THE INVENTION

Traffic cones are manual placed and moved or removed while traffic is flowing. This is not only time consuming, but it presents a safety hazard. The present invention features a traffic cone system for deploying a banner of flat traffic cones. The system of the present invention will allow cones to be displayed in a safe and time-efficient manner.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 4 is a detailed view of the system of the present invention.

DESCRIPTION OF PREFERRED EMBODIMENTS

Figure 1:
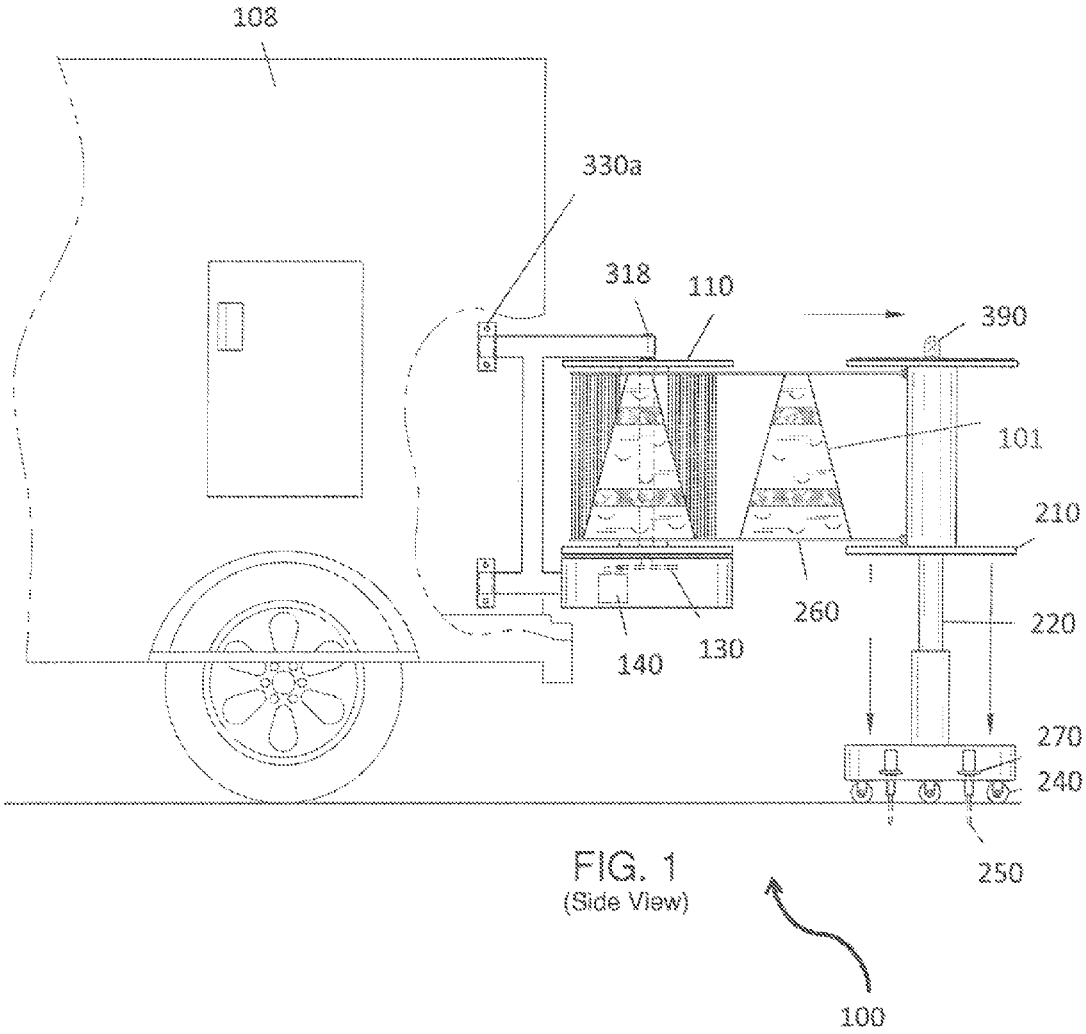
FIG. 1 is a side view of the system of the present invention.
Figure 1A:
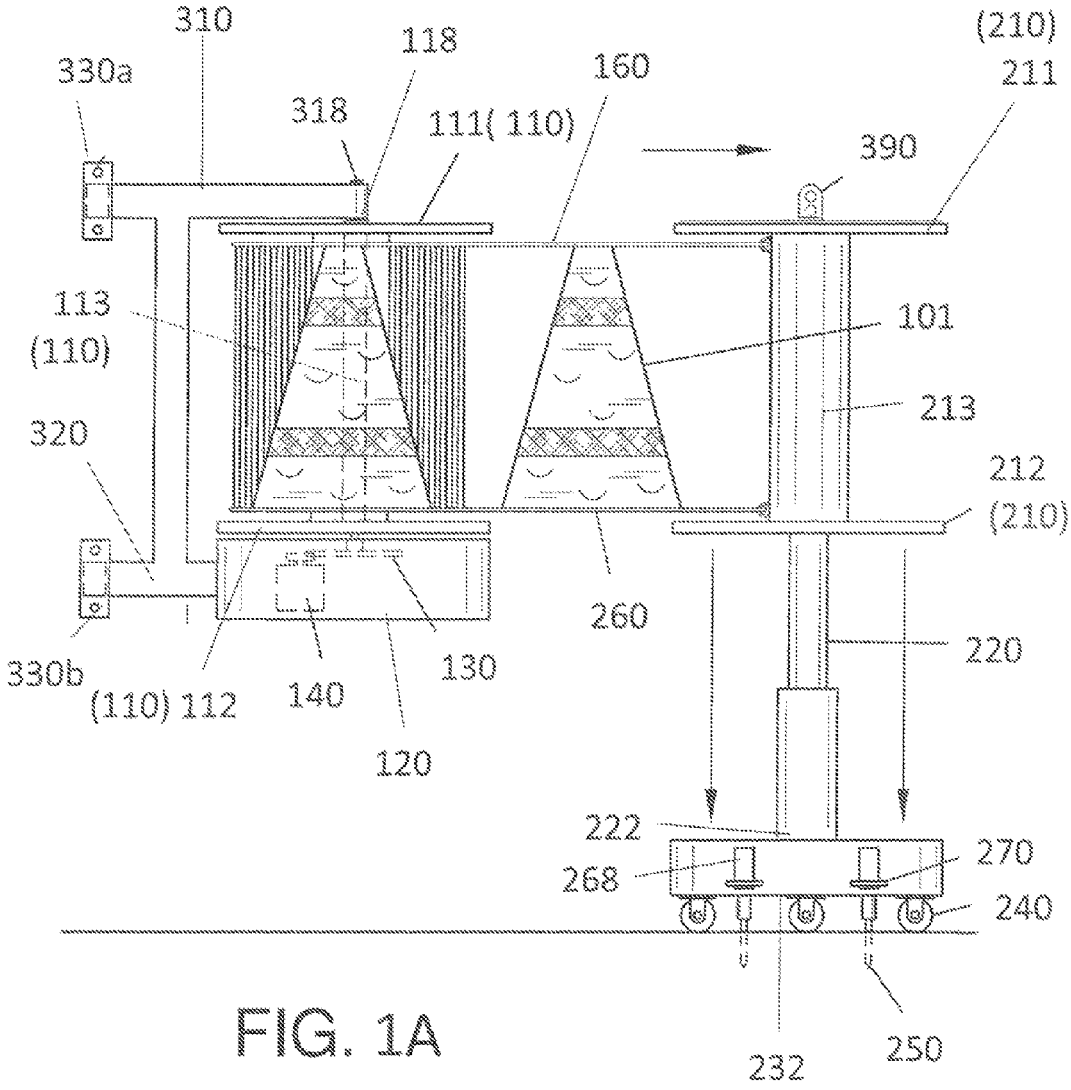
FIG. 1A is a detailed view of the system of FIG. 1.

Referring now to FIGS. 1-7, the present invention features a traffic cone system (100) for deploying a banner of flat traffic cones. The system (100) of the present invention will allow cones to be displayed in a safe and time-efficient manner. In some embodiments, the system (100) comprises a utility vehicle (108), for example a utility vehicle (108) with an inner cavity (108*a*) and an inner wall (108*b*).

The system (100) of the present invention comprises a base spool (110) having a first end (111) and a second end (112) separated by a base shaft (113). The system (100) further comprises a gear box (120). The gear box (120) may be positioned below the second end (112) of the base spool (110). The base shaft (113) (e.g., the bottom end of the base shaft) extends downwardly past the second end (112) of the base (110) and into the gear box (120). The base shaft (113) is operatively connected to gears (130) disposed in the gear box (120).

A motor (140) is disposed in the gear box (120) and is operatively connected to the gears (130). The motor (140) is adapted to effectively cause rotation of the base shaft (113) in a first direction or a second direction. Rotation of the base shaft (113) effectively winds and unwinds the banner (400) of flat triangle cones (101) wound around the base shaft (113). In some embodiments, when the motor (140) is activated, the motor (140) causes the rotation of the base shaft (113) and the winding or unwinding of the banner (400).

The system (100) further comprises a deployment spool (210) having a first end (211) and a second end (212) separated by a deployment shaft (213). An extension shaft (220) extends downwardly from the second end (212) of the deployment shaft (210). The extension shaft (220) can expand and contract in length, e.g., in a telescopic manner. Telescopic shafts are well known to one of ordinary skill in the art. In some embodiments, the extension shaft (220) expands towards the ground surface. In some embodiments, the extension shaft (220) retracts toward the deployment shaft (210). The extension shaft (220) can help position the deployment shaft (210) at an appropriate height (e.g., in line with the base shaft (110).

A ground base (230) is disposed on the bottom end (222) of the extension shaft (220). At least one wheel (240), e.g., a caster wheel, is disposed on a bottom surface (232) of the ground base (230).

Figure 7:
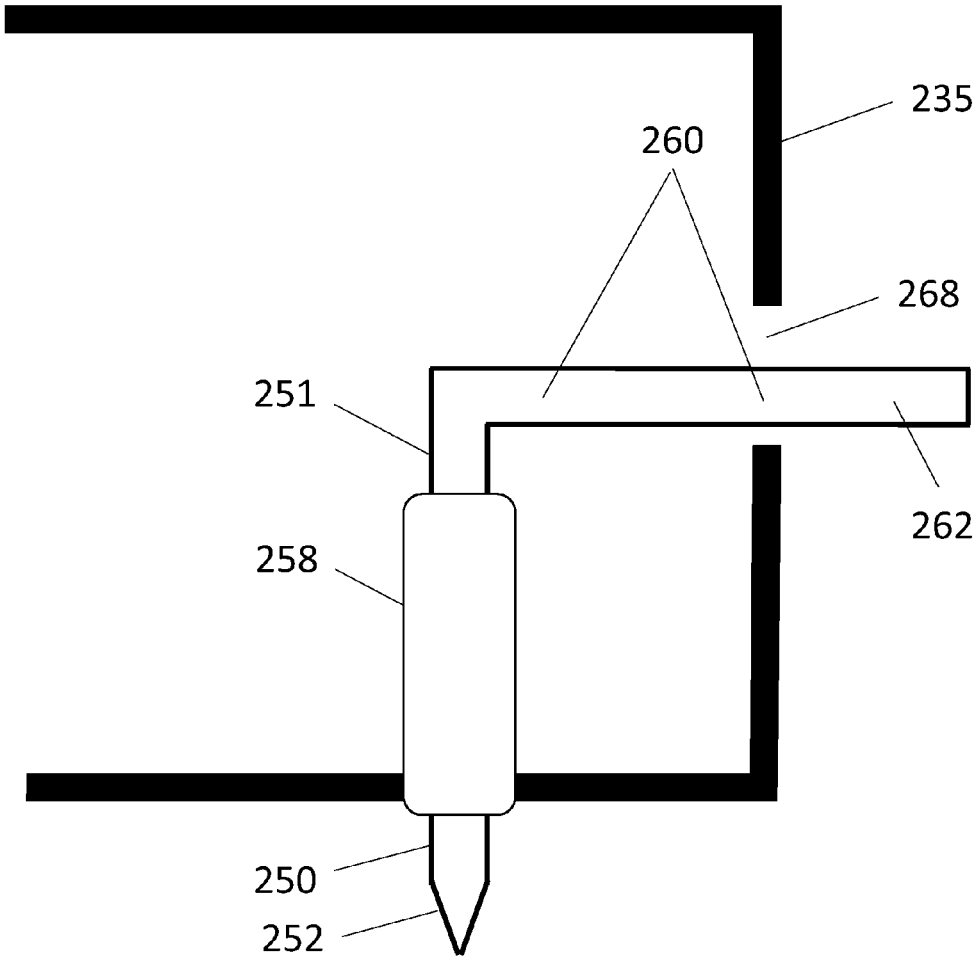
FIG. 7 is a detailed view of the system of the present invention.

The ground base (230) can be anchored to the ground surface. In some embodiments, at least one retractable spike (250) is disposed in the ground base (230). For example, as shown in FIG. 7, the retractable spike (250) is slidably housed in a spike shaft (258) disposed in the ground base (230). The retractable spike (250) has a first end (251) and a second end (252), wherein the second end (252) is pointed. The second end (252) can be extended downwardly from the ground base (230) via the spike shaft (258) or it can be retracted into the ground base (230) via the spike shaft (258).

As shown in FIG. 7, a spike lever (260) is attached to the first end (251) of the retractable spike (250). The spike lever (260) has an outer end (262) that extends outwardly from the side (235) of the ground base (230), e.g., via a pedal slot (268). In some embodiments, a spike pedal (270) is disposed on the outer end (262) of the spike lever (260). The spike pedal (270) (and spike lever (260)) can be depressed so as to cause the spike (250) move downwardly from the spike shaft (258) in the ground base (230), e.g., into a ground surface to anchor the ground base (230). Or, the spike pedal (270) (and spike lever (260)) can be raised so as to cause the spike (250) move upwardly into the spike shaft (258) in the ground base (230).

Figure 2:
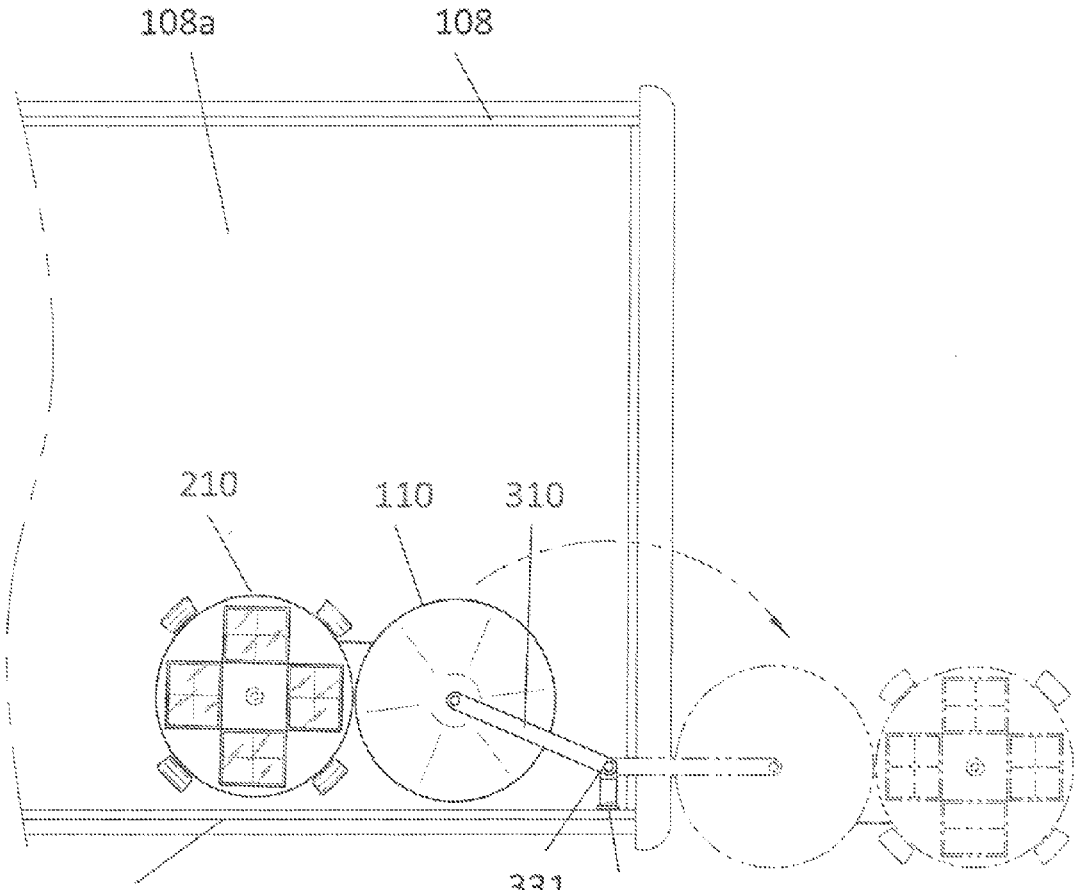
FIG. 2 is a top view of the system of the present invention.
Figure 3:
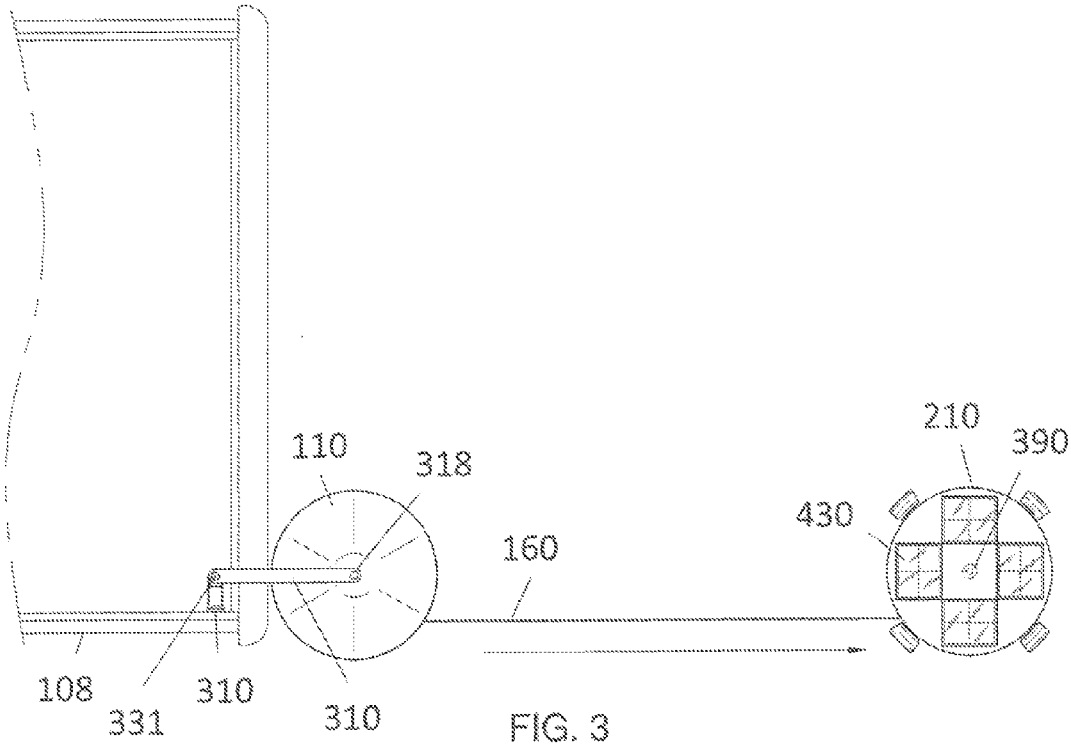
FIG. 3 is a top view of the system of the present invention.
Figure 5:
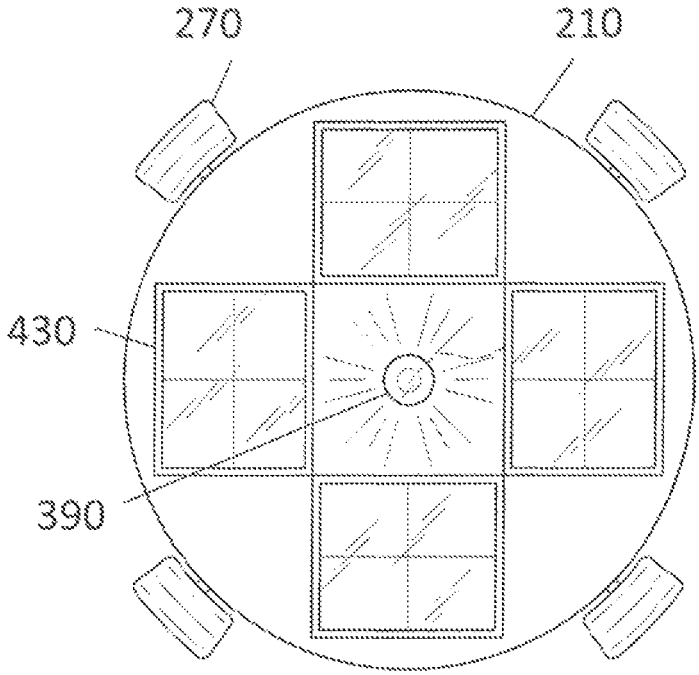
FIG. 5 is a top view of the system of the present invention.
Figure 6:
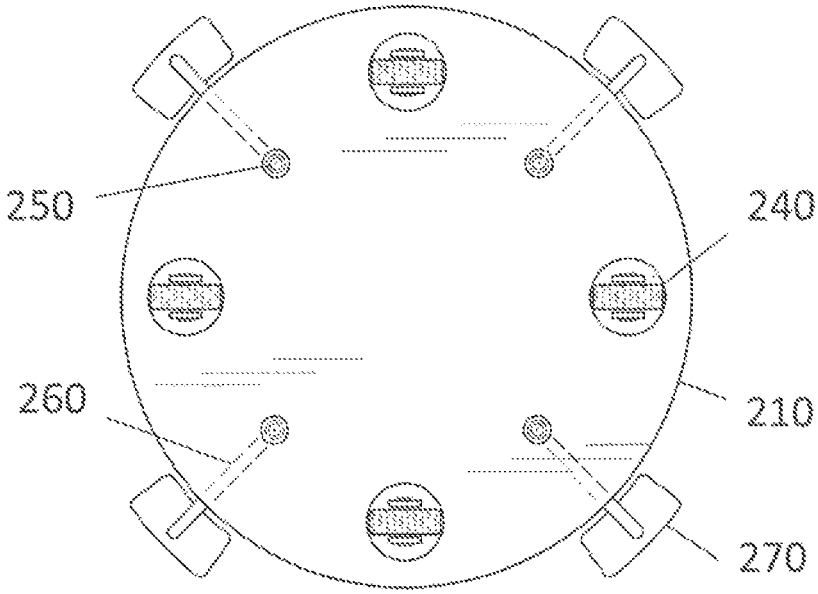
FIG. 6 is a bottom view of the system of the present invention.

The system (100) further comprises a first spool arm (310) and a second spool arm (320) for attaching the base spool (110) to a vehicle (108). The first spool arm (310) has a first end and a second end, and the second spool arm (320) has a first end and a second end. The first end of the first spool arm (310) is pivotally attached to a first mounting brace (330*a*), which is attached to the inner wall (108*b*) inside the inner cavity (108*a*) of the utility vehicle (108). The second end of the first spool arm (310) is pivotally attached to a center point (118) on the first end (111) of the base spool (110) via a hinge (318). The first end of the second spool arm (320) is pivotally attached to a second mounting brace (330*b*), which is attached to the inner wall (108*b*) inside the inner cavity (108*a*) of the utility vehicle (108) below the first mounting brace (330*b*). The second end of the second spool arm (320) is pivotally attached to the gear box (120). The first spool arm (310) and the second spool arm (320) are oriented parallel to each other. As shown in FIG. 2, the spool arms (310, 320) allow the base spool (110) to move in and out of the inner cavity (108*a*) of the utility vehicle (108).

The system (100) further comprises a banner (400) of flat triangle cones (101). The banner (400) is adapted to wrap around the base spool (110) or be unwrapped from the base spool (110). The banner (400) comprises a first cone cable (160) attached to the base shaft (113) at its first end (111) and to the deployment shaft (213) at its first end (211). The banner (400) comprises a second cone cable (260) attached to the base shaft (113) at its second end (112) and to the deployment shaft (213) at its second end (212). Flat triangle cones (101) are arranged adjacent to one another along the banner (in between the cables). The flat triangle cones (101) each have a narrowed top end (102) and a broad bottom end (103). The top end (102) of each flat triangle cone (101) is attached to the first cone cable (160) via an attachment means (e.g., a clamp (360)), and the bottom end (103) is attached to the second cone cable (260) via an attachment means (e.g., via a clamp (360). In some embodiments, the banner (400) is a sheet. In some embodiments, the cones (101) are separated by spaces (400*a*).

A reflective material (380) is disposed on at least a portion of the flat triangle cones (101). In some embodiments, slits (370) are disposed in the flat triangle cones (101) to allow air to pass through the flat triangle cones (101).

The deployment spool (210) can be anchored to a ground surface via the ground base (230). When the base spool (110) is moved away from the deployment spool (210) (by moving the utility vehicle (108) away from the deployment spool (210)), the banner (400) is unwound from the base spool (110).

In some embodiments, the first spool arm (310) is pivotally attached to the first mounting brace (330*a*) via a mounting brace hinge (331).

In some embodiments, the extension shaft (220) can expand and contract via an electrical, manual, or hydraulic mechanism.

In some embodiments, the system (100) further comprises a light (390) disposed on the first end (211) of the deployment spool (210). In some embodiments, the system (100) further comprises a solar panel (430) disposed on the deployment spool (210), e.g., on the first end (211). The solar panel (430) (or an alternative power source) may be operatively connected to the light (390) and/or the extension shaft (220), etc.

As used herein, the term "about" refers to plus or minus 10% of the referenced number.

The disclosures of the following U.S. Patents are incorporated in their entirety by reference herein: U.S. Pat. No. 4,936,485; U.S. Pat. No. 5,054,648; U.S. Pat. No. 5,213,464; U.S. Pat. No. 5,244,334; U.S. Pat. No. 5,525,021; U.S. Pat. No. 6,435,369; U.S. Pat. No. 6,726,434; U.S. Pat. No. 6,752,582; U.S. Pat. Application No. 2006/0054461.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A traffic barrier system (100) for providing traffic barrier, said system (100) comprising:

(a) a utility vehicle (108) with an inner cavity (108*a*) and an inner wall (108*b*);

(b) a base spool (110) having a first end (111) and a second end (112) separated by a base shaft (113);

(c) a gear box (120) disposed below the second end (112) of the base spool (110), the base shaft (113) extends downwardly past the second end (112) of the base (110) and into the gear box (120), the base shaft (113) is operatively connected to gears (130) disposed in the gear box (120);

(d) a motor (140) disposed in the gear box (120) and operatively connected to the gears (130), the motor (140) is adapted to effectively cause rotation of the base shaft (113) in a first direction or a second direction;

(e) a deployment spool (210) having a first end (211) and a second end (212) separated by a deployment shaft (213);

(f) an extension shaft (220) extending downwardly from the second end (212) of the deployment shaft (210), the extension shaft (220) can expand towards a ground surface and contract toward the deployment shaft (210) in a telescopic manner;

(g) a ground base (230) disposed on a bottom end (222) of the extension shaft (220), at least one wheel (240) is disposed on a bottom surface (232) of the ground base (230);

(h) at least one retractable spike (250) disposed in the ground base (230), the retractable spike (250) is slidably housed in a spike shaft (258) disposed in the ground base (230), the retractable spike (250) has a first end (251) and a second end (252), the second end (252) is pointed, the second end (252) can be extended downwardly from the ground base (230) or be retracted into the ground base (230);

(i) a spike lever (260) attached to the first end (251) of the retractable spike (250), the spike lever (260) has an outer end (262) that extends outwardly from a side (235) of the ground base (230) via a pedal slot (268), wherein a spike pedal (270) is disposed on the outer end (262) of the spike lever (260), the spike pedal (270) and spike lever (260) can be depressed so as to cause the spike (250) move downwardly from the spike shaft (258) in the ground base (230) or the spike pedal (270) and spike lever (260) can be raised so as to cause the spike (250) move upwardly into the spike shaft (258) in the ground base (230);

(j) a first spool arm (310) having a first end and a second end, the first end is pivotally attached to a first mounting brace (330*a*), the first mounting brace (330*b*) is attached, to the inner wall (108*b*) inside the inner cavity (108*a*) of the utility vehicle (108), the second end is pivotally attached to a center point (118) on the first end (111) of the base spool (110) via a hinge (318);

(j) a second spool arm (320) having a first end and a second end, the first end is pivotally attached to a second mounting brace (330*b*), the second mounting brace (330*b*) is attached to the inner wall (108*b*) inside the inner cavity (108*a*) of the utility vehicle (108) below the first mounting brace (330*b*), the second end is pivotally attached to the gear box (120), the first spool arm (310) and the second spool arm (320) are oriented parallel to each other, the spool arms (310, 320) allow the base spool (110) to move in and out of the inner cavity (108*a*) of the utility vehicle (108);

(k) a banner (400) adapted to wrap around the base spool (110) or be unwrapped from the base spool (110), the banner (400) comprises a first cone cable (160) attached to the base shaft (113) at its first end (111) and to the deployment shaft (213) at its first end (211), a second cone cable (260) attached to the base shaft (113) at its second end (112) and to the deployment shaft (213) at its second end (212), and an plurality of flat triangle cones (101) arranged adjacent to one another, the flat triangle cones (101) each have a narrowed top end (102) and a broad bottom end (103), the top end (102) of each flat triangle cone (101) is attached to the first cone cable (160) via an attachment means, and the bottom end (103) is attached to the second cone cable (260) via an attachment means, a reflective material (380) is disposed on at least a portion of the flat triangle cones (101);

wherein the deployment spool (210) can be anchored to a ground surface via the ground base (230), when the base spool (110) is moved away from the deployment spool (210) by moving the utility vehicle (108) away from the deployment spool (210), the banner (400) is unwound from the base spool (110);

wherein when the motor (140) is activated, the motor (140) causes the base shaft (113) to rotate to wind or unwind the banner (400).

2. The system (100) of claim 1, wherein the wheel (240) is a caster wheel.

3. The system (100) of claim 1, wherein the first spool arm (310) is pivotally attached to the first mounting brace (330*a*) via a mounting brace hinge (331).

4. The system (100) of claim 1, wherein the plurality of flat triangle cones are separated by spaces (400*a*).

5. The system (100) of claim 1, wherein slits (370) are disposed in the flat triangle cones (101) to allow air to pass through the flat triangle cones (101).

6. The system (100) of claim 1, wherein the attachment means is a clamp (360).

7. The system (100) of claim 1 further comprising solar panels (430) disposed on the first end (211) of the deployment spool.

8. The system (100) of claim 1 further comprising a light (390) disposed on the first end (211) of the deployment spool (210).

* * * * *